US006006861A

United States Patent [19]

Clinton

[11] Patent Number: 6,006,861

[45] Date of Patent: Dec. 28, 1999

[54] RAILROAD CROSSING GATE LADDER ASSEMBLY

[75] Inventor: Mark A. Clinton, Louisville, Ky.

[73] Assignee: Progress Rail Services, Lincoln Industries Division, Louisville, Ky.

[21] Appl. No.: 08/437,543

[22] Filed: May 9, 1995

[51] Int. Cl.[6] ..... E04G 3/00

[52] U.S. Cl. ..... 182/97

[58] Field of Search ..... 182/97, 88, 91

[56] References Cited

U.S. PATENT DOCUMENTS

| | | |
|---|---|---|
| 756,034 | 3/1904 | Maxey . |
| 2,840,290 | 6/1958 | Roberts . |
| 2,860,822 | 11/1958 | Smith et al. . |
| 3,653,463 | 4/1972 | Neal et al. . |
| 4,546,855 | 10/1985 | Lyons . |
| 4,924,970 | 5/1990 | Seals et al. . |
| 5,024,291 | 6/1991 | Price . |
| 5,046,582 | 9/1991 | Albrecht . |
| 5,064,022 | 11/1991 | Graham . |

FOREIGN PATENT DOCUMENTS

| | | | |
|---|---|---|---|
| 0571558 | 10/1958 | Belgium | 182/97 |
| 0222122 | 5/1910 | Germany | 182/97 |
| 1036727 | 8/1958 | Germany | 182/97 |
| 0504170 | 12/1954 | Italy | 182/97 |
| 0019659 | 1/1890 | United Kingdom | 182/97 |

*Primary Examiner*—Tamara L. Graysay
*Assistant Examiner*—Matthew A. Kaness
*Attorney, Agent, or Firm*—Nixon & Vanderhye P.C.

[57] ABSTRACT

A support or a railroad crossing gate and warning structure (such as warning lights mounted on a cantilever) has first and second ladders. The first ladder is stationarily mounted on the support so that its bottom rung is spaced from the ground, and the second ladder is mounted adjacent its top end for movement along the stationary ladder between a position where it is above the ground, to a position in which its bottom end is on the ground. The second ladder is also pivotally mounted at its top end to slides which engage the first ladder. Retaining plates are provided for releasably retaining the bottom end of the second ladder in a position in which it is mounted on or at least horizontally adjacent the first ladder, and the plates may be effectively locked together with a padlock to prevent unauthorized use.

20 Claims, 5 Drawing Sheets

FIG. 6
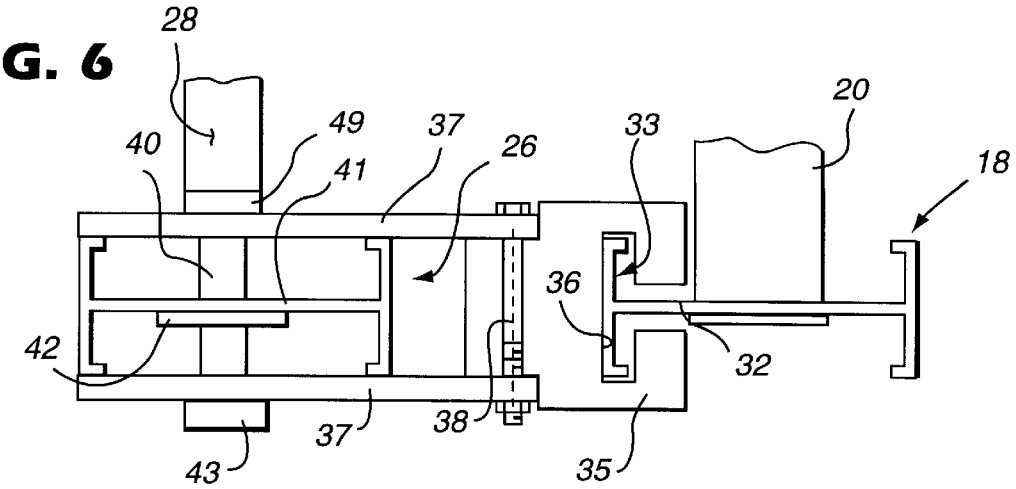
FIG. 7
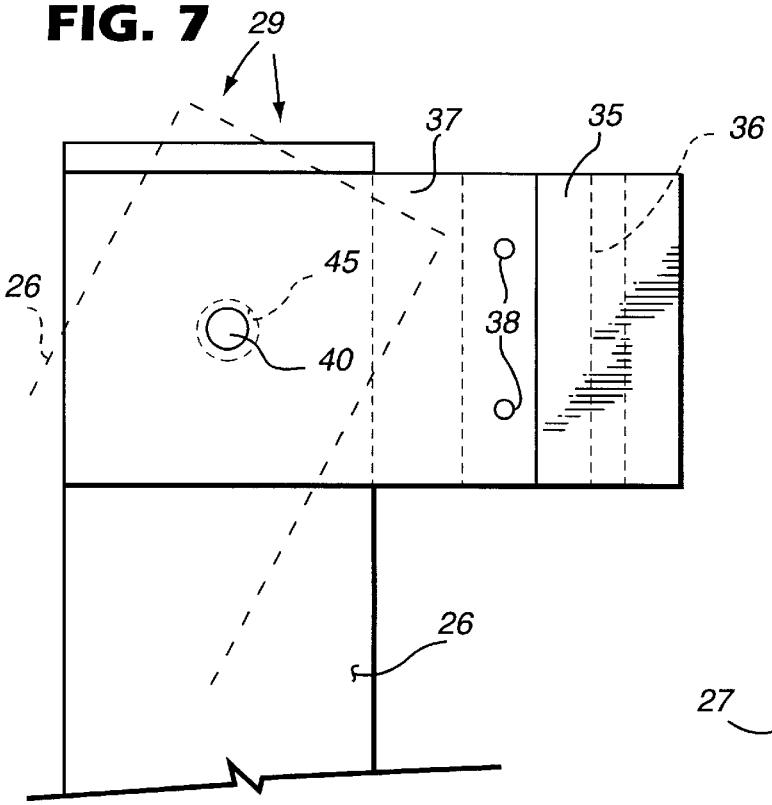
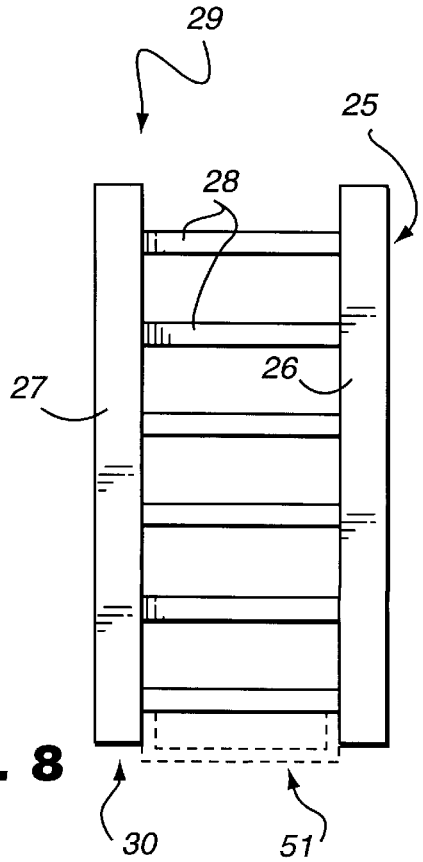
FIG. 8

FIG. 9
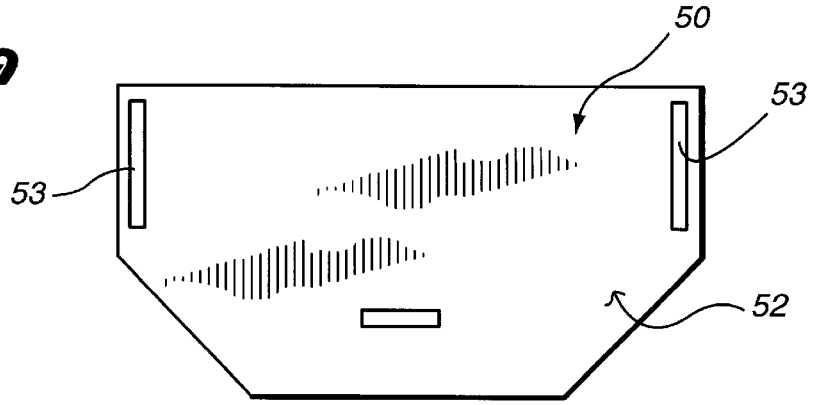
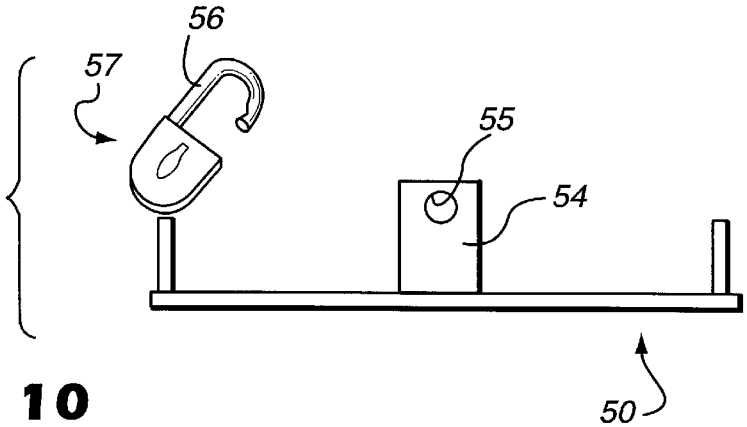
FIG. 10
FIG. 11
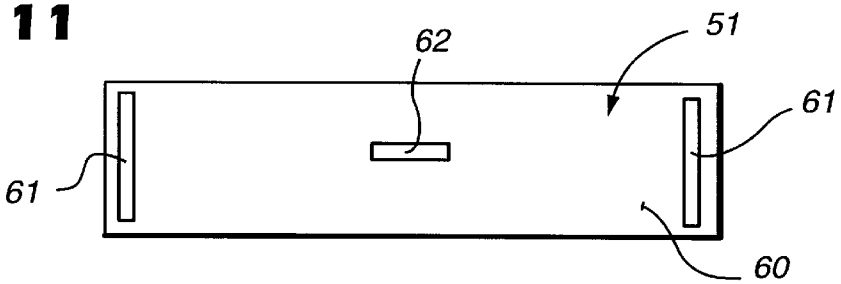
FIG. 12
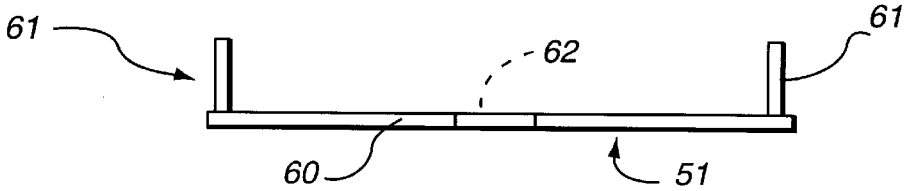

RAILROAD CROSSING GATE LADDER ASSEMBLY

BACKGROUND AND SUMMARY OF THE INVENTION

Railroad crossings typically have a crossing gate and various warning indicia. Desirably warning is provided by mounting warning lights, signs, and the like on a cantilever mechanism connected to the support for the crossing gate. In order to be able to effectively service these lights, a ladder is typically provided on the support structure, having the bottom rung thereof spaced a large distance from the ground so as to discouraged unauthorized users from climbing up the ladder. However that poses a safety problem for authorized people when they wish to access the cantilever structure, warning lights, and the like.

According to the present invention, a ladder assembly is provided particularly for use with a crossing gate support in which a second ladder is slidable with respect to the stationary ladder, and can be moved from a position well above the ground to a position where it is supported by the ground, at an angle, so that an authorized person may readily climb up it to repair the warning lights or other structures on the cantilever arm, or otherwise associated with the crossing gate support. Because of the particular construction of the movable ladder, it can be locked in place. The ladder assembly according to the present invention thus provides safety for authorized users, while retarding access by unauthorized users to the same extent as is provided in conventional railroad crossing supports.

According to one aspect of the present invention a ladder assembly is provided comprising the following components: A first, stationary, ladder having first and second side rails, a bottom rung, and a top rung. The first ladder mounted so that the bottom rung is spaced from a ground or floor surface. A second movable, ladder having first and second side rails and a plurality of rungs, a top end, and a bottom end. Means for movably mounting the second ladder adjacent the top end thereof for movement along the stationary ladder from a first position in which the bottom end is spaced from the ground or floor surface, and a second position in which the bottom end engages the ground or floor surface. Means for pivotally mounting the second ladder to the mounting means for pivotal movement about a generally horizontal axis so that the bottom end of the second ladder is movable horizontally toward and away from the first ladder. And, means for retaining the bottom end of the second ladder in a position horizontally adjacent the first ladder.

The means for movably mounting the second ladder adjacent the top end thereof may comprise first and second slides each having a first ladder side rail receiving recess therein, and the pivotally mounting means may mount the side rails of the second ladder to the first and second slides. The slides can have almost any configuration, but it is particularly desirable to have the stationary ladder side rails as I beams, each having a generally T-shaped portion which is received within a T-shaped recess in each of the slides. A pivot pin, or one of the ladder rungs, may connect each side rail of the second ladder to a slide.

The retaining means may comprise at least one plate mounted to the first ladder and having at least one projection thereon which can releasably hold a portion of the second ladder, as for example passing through a slot in a lock bracket on the second ladder. The projection on the retaining means plate may include an opening for receipt of a padlock hasp, particularly when the first ladder is mounted to a support for a railroad crossing gate and warning structure. The retaining means also may comprise means for stopping movement of the movable mounting means. For ease of construction the second ladder also preferably has side rails each having an I-shape in cross-section.

According to another aspect of the present invention a method of gaining access to a stationary ladder mounted on a stationary support extending from a ground or floor having a bottom rung spaced from the ground or floor, and using a second ladder shorter than the first ladder, is provided. The method comprises the following steps: (a) Sliding the second ladder downwardly with respect to the first ladder so that a bottom portion of the second ladder engages the ground or floor. And, (b) moving the bottom portion of the second ladder horizontally away from the first ladder, and with the bottom portion thereof in contact with the ground or floor, while a top portion of the second ladder remains in operative contact with the first ladder. There may also be the further step, prior to step (a), of (c) detaching the second ladder bottom portion from the first ladder. The first ladder is typically stationarily mounted on a railroad crossing gate and signalling assembly support, and the method comprises the further step of unlocking a padlock prior to step (c) to allow detachment of the second ladder from the first ladder.

According to still another aspect of the present invention a railroad crossing and ladder assembly is provided comprising: A support for a railroad crossing gate and warning structure. A first ladder having a first length, first and second side rails, and a plurality of rungs extending between the side rails, the first ladder mounted to the support. A second ladder having a second length, less than the first length, first and second side rails and a plurality of rungs extending between the side rails. And, the second ladder mounted for sliding movement with respect to the first ladder, and for pivotal movement with respect to the first ladder.

The assembly typically further comprises first and second retaining plates mounted to the first and second ladders, respectively, to releasably hold the second ladder to the first ladder precluding relative pivotal movement therebetween, the retaining plates including openings therein for receipt of a padlock or the like to lock them together. Typically both the first and second ladder side rails have I-shaped cross-sections.

It is the primary object of the present invention to provide a simple yet effective ladder assembly, particularly for a railroad crossing structure, and a method of gaining access to a stationary ladder. This and other objects of the invention will become clear from an inspection of the detailed description of the invention and from the appended claims.

BRIEF DESCRIPTION OF THE DRAWINGS

FIG. 6 is a top plan detail view of an exemplary connection between the movable and stationary ladders according to the invention of FIGS. 3 through 5;

FIG. 7 is a side detail schematic view showing pivotal action of the movable ladder with respect to the stationary ladder;

FIG. 8 is a front view of the movable ladder of FIGS. 3 through 7;

FIG. 9 is a top plan view of an exemplary embodiment of a stationary ladder lock bracket according to the invention;

FIG. 10 is a front view of the lock bracket of FIG. 9 and also showing a padlock which may be utilized in association therewith; and FIGS. 11 and 12 are top and front views, respectively, of an exemplary embodiment of a lock bracket utilized with the movable ladder of the ladder assembly of FIGS. 3 through 8, for cooperation with the lock bracket of FIGS. 9 and 10.

DETAILED DESCRIPTION OF THE DRAWINGS

Figure 1:
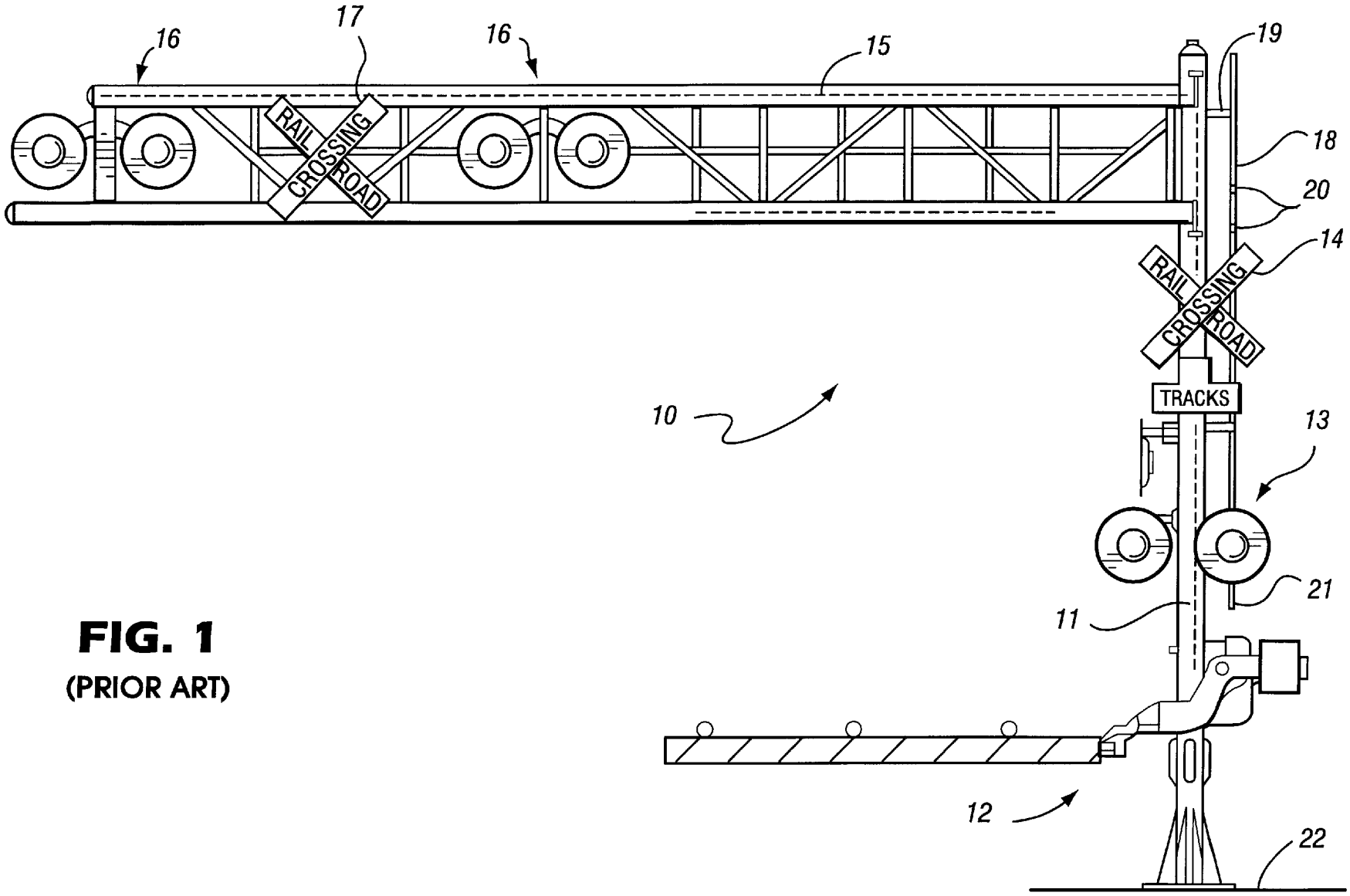
FIG. 1 (PRIOR ART)
FIG. 1 is a side view of an exemplary conventional railroad crossing gate and warning structure with which the invention may be used.

FIG. 1 shows an exemplary conventional crossing gate and warning structure 10. A metal support 11, which may be a metal pole anchored into the ground and/or connected by bolts or the like to a concrete footing, typically includes a conventional crossing gate 12 mounted thereto, as well as warning lights 13, warning indicia 14, and the like. A cantilever structure 15 is typically mounted adjacent the top of the support 11 and which also mounts warning structures, including lights 16, warning indicia 17, and the like. In order to gain access to the structures mounted on the cantilever 15, particularly the lights 16 which need replacement or repair, a stationary ladder 18 is provided mounted to the support 11 by mounting brackets 19 or the like, the ladder 18 including a plurality of rungs 20, including a bottommost rung 21 which is spaced a significant distance (e.g. on the order of six feet or more) from the ground or floor surface 22 in which the vertical support pole 11 is anchored.

Figure 2:
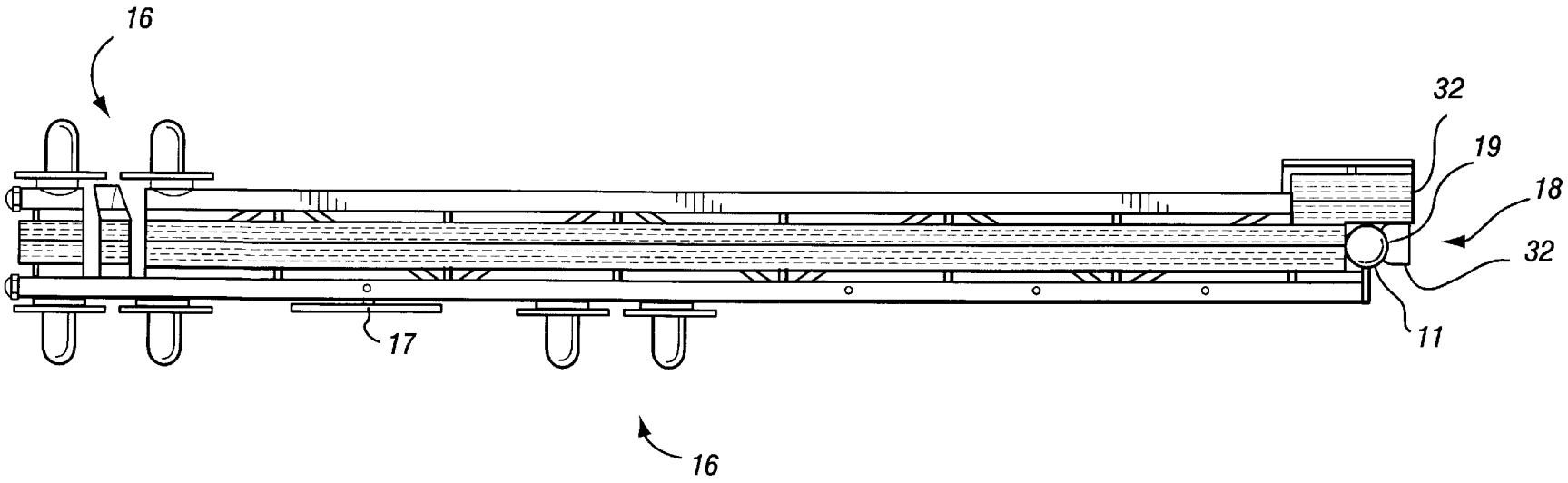
FIG. 2 (PRIOR ART)
FIG. 2 is a top plan view of the conventional structure of FIG. 1, only not showing the crossing gate.

In order to provide safe access by authorized workers to the stationary ladder 18 in the conventional structures of FIGS. 1 and 2, according to the present invention a movable ladder—shown generally by reference numeral 25 in FIGS. 3 through 8—is provided. The movable ladder 25—as seen schematically in FIG. 8—includes first and second side rails 26, 27, a plurality of rungs 28 connected between the side rails 26, 27 and essentially perpendicular thereto, a top end 29, and a bottom end 30. The stationary ladder 18, as is conventional, also preferably has a pair of side rails 32 which interconnect the rungs 20, 21 thereof. According to the present invention it is desirable that the side rails 32 have an I-beam cross-section, as seen in FIG. 6, including a generally T-shaped portion 33 thereof.

Figure 3:
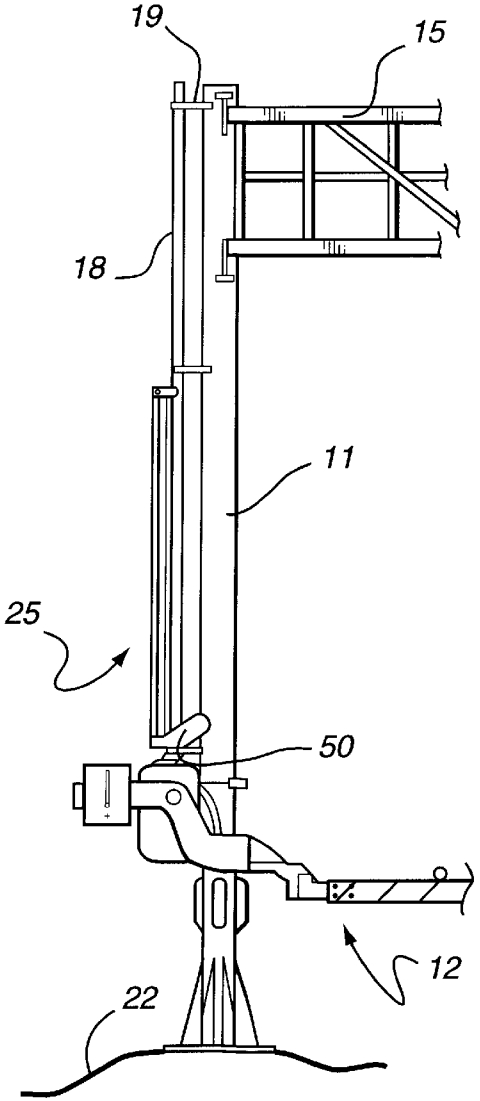
FIGS. 3 through 5 are side views of the crossing gate support of FIGS. 1 and 2 showing an exemplary ladder assembly according to the present invention, and illustrating three different positions of the movable ladder with respect to the stationary ladder.
Figure 5:
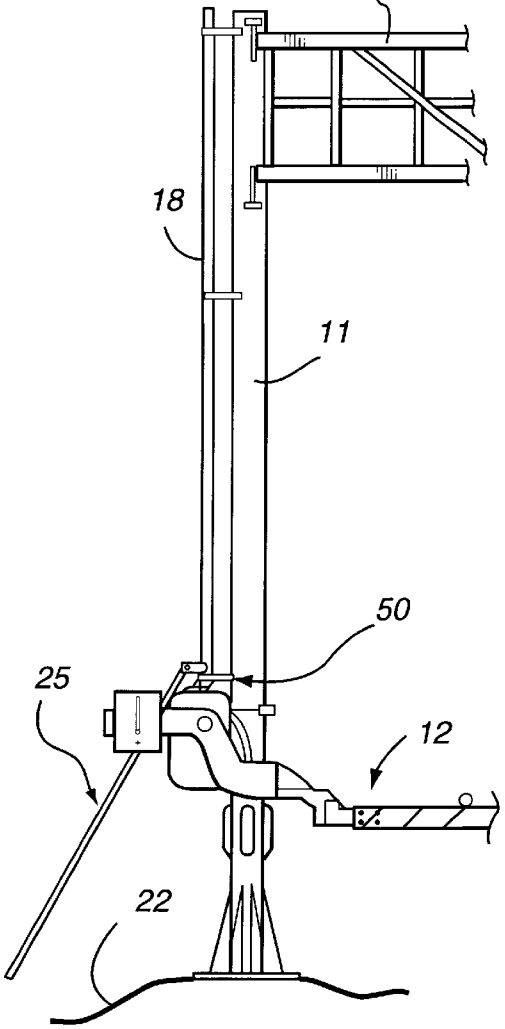

The side rails 26, 27 of the movable ladder 25 are connected to means for movably mounting the second ladder 25 adjacent the top end 29 thereof for movement along the stationary ladder 18 from a first position—as illustrated in FIG. 3—in which the bottom end 30 thereof is spaced from the ground or floor surface 22, and a second position—FIG. 5—in which the bottom end 30 engages the ground or floor surface 22. The mounting means may take a wide variety of configurations. In the preferred configuration illustrated in FIGS. 6 and 7, a metal slide plate or bar or the like, shown generally by reference numeral 35, is provided which has a T-shaped recess 36 therein which receives the T-shaped portion 33 of the side rail 32 of stationary ladder 18, as seen in FIG. 6, there being a slight play between the two so that the structure 35 slides up and down along the T-shaped element 33. The slide 35 may be connected to a side rail 26 of the movable ladder 25—as illustrated in FIG. 6—by arms 37 connected by two or more bolts 38 or the like to the slide 35 with the side rail 26 received between the arms 37.

While the slide 35 and arm 37 structure illustrated in FIGS. 6 and 7 is highly desirable, the means for movably mounting the second ladder with respect to the first may comprise a wide variety of other structures. For example cooperating pipe sections may be provided for the stationary ladder portion 18 and for moving the movable ladder 25 up and down thereon, or telescoping elements, or the stationary ladder 18 may have elements comprising recesses with which projections from the slide 35 cooperate, or a wide variety of other configurations may be provided.

Figure 4:
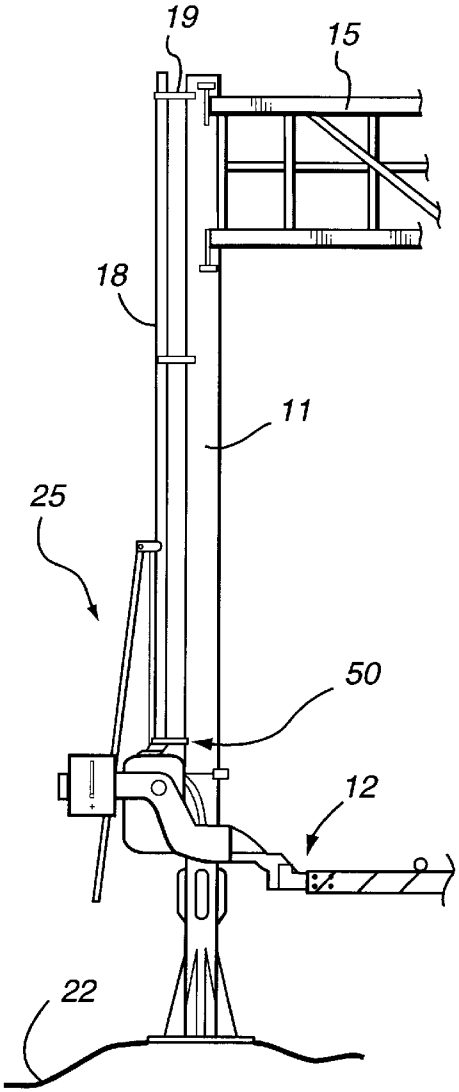

Also according to the present invention means are preferably provided for pivotally mounting the second ladder 25 to the mounting means—such as the slide 35 and arms 37—for movement about a generally horizontal axis so that the bottom end 30 of the second ladder 25 is movable horizontally toward and away from the first ladder 18, and support 11, as seen in FIGS. 4 and 5. The pivotally mounting means may also comprise a wide variety of structures. For example pivotal mounting may be provided by passing a pivot pin 40 (see FIGS. 6 and 7) through the arms 37 and through a central portion 41 of a side rail 26, which may have a reinforcing plate 42 thereat, the pivot pin 40 connected to the arms 37 by a head 43 and nut 44, or by other fastening components (either removable or permanent), with the pivot pin 40 received in an opening 45 (see FIG. 7) in the central portion 41 and reinforcing plate 42. As seen in the dotted line position in FIG. 7, if the bottom 30 of the ladder 25 is not restrained, side rail 26 may be pivoted about the horizontal axis defined by the pivot pin 40 so that the bottom end 30 moves away from the vertical support 11 and the stationary ladder 18.

While a separate pivot pin 40 is shown in FIGS. 6 and 7, the pivotal mounting means may alternatively comprise a top rung 28 of the ladder 25, or any other suitable structure such as conventional hinge, piano hinge, or the like.

It should also be understood that while FIGS. 6 and 7 merely show one side rail 26, 32 for each of the moveable and stationary ladders 25, 18, a comparable structure is provided for the other side rails 32, and 27. As seen in FIG. 6, in the preferred embodiment both of the ladders 18, 25 have the side rails 32, 26, 27 thereof in the shape of I-beams.

It is highly desirable to be able to lock the ladder 25 in place so that only authorized persons may gain access thereto, or at least to normally hold it in the first position thereof as illustrated in FIG. 3. To this end means for retaining the bottom end 30 of the second ladder 25 in a position horizontally adjacent the first ladder 18—as illustrated in FIG. 3—are provided. The retaining means may take a wide variety of forms, from simple detents, simple spring pressed latches, to accessory locking structures such as large locks, bars, or twisted and tied cables or ropes. However in the preferred embodiment the simple retaining means illustrated in FIGS. 9 through 12 are utilized, which includes a first lock bracket 50 (FIGS. 9 and 10) mounted to at least one side rail 32 of the stationary ladder 18, and a second lock bracket 51 (FIGS. 11 and 12) mounted to at least one side rail of the movable ladder 25.

In the preferred embodiment the bracket 50 includes a metal plate 52 having upstanding side ears 53, the ears 53 being spaced from each other the approximate spacing of the side rails 32 of the ladder 18. The ears 53 may be attached by fasteners, by welding, or otherwise affixed to the ladder 18 just above, below, or near the bottom rung 21 thereof, as seen in FIGS. 3 through 5. Also upstanding from the plate 52 is a projection 54 having an opening 55 therein. The opening 55 (e.g. a one-half inch diameter round hole) is preferably dimensioned to receive the hasp 56 (see FIG. 10) of a conventional padlock 57 or the like.

The lock bracket 51 also preferably comprises a metal plate, 60, having upstanding side ears 61, the ears 61 adapted to be attached by bolts, welding, or other fastening mechanisms to the side rails 26, 27 of the ladder 25, adjacent the bottom 30 thereof, as illustrated schematically at 51 in FIG. 8. The plate 60 includes a slot 62 therein which has dimensions slightly larger than the dimensions of the projection 54 so that when the ladder 25 is mounted in the position illustrated in FIG. 3 the projection 54 passes through the slot 62 and the bottom of the plate 60 substantially engages the top of the plate 52. Thus when the projection 54 is received in the slot 62 and the hasp 56 of the padlock 57 is passed through the opening 55, the ladders 25, 18 are locked together so that only an authorized user may gain access to the ladder 25 to move it to the positions illustrated in FIGS. 4 and 5. It should also be noted that the bracket 50 serves as a stop mechanism for stopping downward movement of the ladder 25—as illustrated in FIG. 5—in its use position.

In the normal use of the movable ladder 25 according to the invention, a person who wants to gain access to the cantilever 15 and the lights 16 or the like supported thereon unlocks the padlock 57, removes the hasp 56 from the opening 55, and then moves the ladder 25 upward slightly so that the slot 62 clears the projection 54. Then the bottom end 30 of the ladder 25 is moved horizontally outwardly—as illustrated in FIG. 4—and under its own weight the ladder 25 slides downwardly toward the ground 22, because of cooperation of the slides 35 and the portions 33 of the stationary ladder side brackets 32. Once the slides 35 reach the level of the plate 52, they are stopped by the plate 52—illustrated in FIG. 5—and the bottom end 30 of the movable ladder 25 is horizontally spaced from the support 11 and engages the ground 22. Then the authorized user can easily climb up the rungs 28 of the short, movable ladder 25, to gain access to the rungs 21, 20 of the stationary ladder 18, and then climb the stationary ladder 18 to the cantilever 15.

It will thus be seen that according to the present invention an advantageous ladder assembly, method of gaining access to a stationary ladder, and railroad crossing and ladder assembly, are provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A ladder assembly comprising:

a first, stationary, ladder having first and second side rails, a bottom rung, and a top rung;

said first ladder mounted so that said bottom rung is spaced from a ground or floor surface;

a second movable, ladder having first and second side rails and a plurality of rungs, a top end, and a bottom end;

means for movably mounting said second ladder adjacent said top end thereof for movement along said stationary ladder from a first position in which said bottom end is spaced from the ground or floor surface, and a second position in which said bottom end engages the ground or floor surface;

means for pivotally mounting said second ladder to said mounting means for pivotal movement about a generally horizontal axis so that said bottom end of said second ladder is movable horizontally toward and away from said first ladder; and means for retaining said bottom end of said second ladder in a position horizontally adjacent said first ladder.

2. A ladder assembly as recited in claim 1 wherein said means for movably mounting said second ladder adjacent said top end thereof comprises first and second slides each having a first ladder side rail-receiving recess therein.

3. A ladder assembly as recited in claim 2 wherein said pivotally mounting means mounts said side rails of said second ladder to said first and second slides.

4. A ladder assembly as recited in claim 3 wherein said pivotally mounting means comprises a pivot pin connecting each side rail of said second ladder to a said slide.

5. A ladder assembly as recited in claim 4 wherein said retaining means comprises at least one plate mounted to said first ladder, and having at least one projection thereon which can engage and releasably hold a portion of said second ladder.

6. A ladder assembly as recited in claim 5 wherein said first ladder is mounted to a support for a railroad crossing gate and warning structure, and wherein said retaining means plate includes an opening for receipt of a padlock hasp.

7. A ladder assembly as recited in claim 5 wherein said retaining means at least one plate is mounted so that it provides a stop to downward movement of at least one of said slides.

8. A ladder assembly as recited in claim 5 wherein said first ladder is mounted to a support for a railroad crossing gate and warning structure.

9. A ladder assembly as recited in claim 3 wherein said pivotally mounting means comprises a pivot pin connecting each side rail of said second ladder to a said slide.

10. A ladder assembly as recited in claim 2 wherein said first ladder side rails each have a T-shaped portion, and wherein said recesses of each of said slides is T-shaped to fit a said T-shaped portion of said first ladder side rail.

11. A ladder assembly as recited in claim 1 wherein said retaining means comprises means for stopping movement of said movably mounting means.

12. A ladder assembly as recited in claim 1 wherein said pivotally mounting means pivotally mounts said side rails of said second ladder to said movably mounting means.

13. A ladder assembly as recited in claim 1 wherein said second ladder side rails each have an I-shape in cross-section.

14. A ladder assembly as recited in claim 13 wherein said first ladder side rails each have an I-shape in cross-section.

15. A method of gaining access to a stationary ladder mounted on a stationary support extending from a ground or floor having a bottom rung spaced from the ground or floor, and using a second ladder shorter than the first ladder, comprising the steps of:

(a) sliding the second ladder downwardly with respect to the first ladder so that a bottom portion of the second ladder engages the ground or floor; and (b) moving the bottom portion of the second ladder horizontally away from the first ladder, and with the bottom portion thereof in contact with the ground or floor, while a top portion of the second ladder remains in operative contact with the first ladder.

16. A method as recited in claim 15 comprising the further step, prior to step (a), of (c) detaching the second ladder bottom portion from the first ladder.

17. A method as recited in claim 16 wherein the first ladder is stationarily mounted on a railroad crossing gate and signalling assembly support, and comprising the further step of unlocking a padlock locking the second ladder bottom portion to the first ladder prior to step (c) to allow detachment of the second ladder from the first ladder.

18. A railroad crossing and ladder assembly comprising:

a support for a railroad crossing gate and warning structure;

a first ladder having a first length, first and second side rails, and a plurality of rungs extending between said side rails, said first ladder mounted to said support;

a second ladder having a second length, less than said first length, first and second side rails and a plurality of rungs extending between said side rails; and said second ladder mounted for sliding movement with respect to said first ladder, and for pivotal movement with respect to said first ladder.

19. An assembly as recited in claim 18 further comprising first and second metal retaining plates mounted to said first and second ladders, respectively, to releasably hold said second ladder to said first ladder precluding relative pivotal movement therebetween, at least one of said retaining plates including an opening therein for receipt of a padlock hasp or the like to lock said first and second retaining plates together.

20. An assembly as recited in claim 19 wherein both said first and second ladder side rails have I-shaped cross sections.

* * * * *